United States Patent [19]

Masuda et al.

[11] 4,055,432

[45] Oct. 25, 1977

[54] THERMODEVELOPABLE PHOTOGRAPHIC MATERIAL

[75] Inventors: Takao Masuda, Asaka; Keiichi Adachi, Minami-ashigara both of Japan

[73] Assignee: Fuji Photo Film Co., Ltd., Minami-ashigara, Japan

[21] Appl. No.: 744,855

[22] Filed: Nov. 24, 1976

Related U.S. Application Data

[63] Continuation-in-part of Ser. No. 434,326, Jan. 17, 1974, abandoned.

[30] Foreign Application Priority Data

Jan. 18, 1973 Japan ..... 48-8194

[51] Int. Cl.[2] ..... G03C 1/02; G03C 1/34

[52] U.S. Cl. ..... 96/114.1; 96/109

[58] Field of Search ..... 96/114.1, 109, 67; 427/261

[56] References Cited

U.S. PATENT DOCUMENTS

| | | | |
|---|---|---|---|
| 3,839,041 | 10/1974 | Hiller | 96/114.1 |
| 3,846,136 | 11/1974 | Sullivan | 96/114.1 |
| 3,877,940 | 4/1975 | Ericson | 96/114.6 |

FOREIGN PATENT DOCUMENTS

| | | | |
|---|---|---|---|
| 768,071 | 6/1971 | Belgium | 96/114.1 |

*Primary Examiner*—David Klein
*Assistant Examiner*—Louis Falasco
*Attorney, Agent, or Firm*—Sughrue, Rothwell, Mion, Zinn and Macpeak

[57] ABSTRACT

A thermodevelopable photographic material having a reduced tendency to fog formation by heat, comprising a support and at least one layer containing (a) an organic silver salt, (b) a catalytic amount of a photosensitive silver halide or a compound capable of forming a photosensitive silver halide by reaction with the organic silver salt (a), (c) a binder, (d) a reducing agent, and (e) a specific bromine-containing heterocyclic compound. In order to increase the transparency of the thermodevelopable photographic layer of the material and the density of the image and to improve its storability, a topcoating of polymer can be formed on the photographic layer.

12 Claims, No Drawings

THERMODEVELOPABLE PHOTOGRAPHIC MATERIAL

CROSS-REFERENCE TO RELATED APPLICATIONS

This application is a continuation-in-part application of Ser. No. 434,326, filed Jan. 17, 1974, by Takao Masuda et al., entitled "Thermodevelopable Photographic Material," abandoned.

BACKGROUND OF THE INVENTION

1. Field of the Invention

This invention relates to a thermodevelopable photographic material, and particularly to a thermodevelopable photographic material containing a compound which inhibits fog caused by heating (development) (to be referred to hereinafter simply as "fog").

2. Description of the Prior Art

Photographic processes utilizing silver halides have previously gained most widespread acceptance because they give rise to superior photographic characteristics, such as sensitivity and gradation, to methods such as electrophotographic or diazo-type photographic processes. Silver halide photographic materials used in these methods are first developed with a developer after imagewise exposure. Then, in order for the developed image not to discolor or fade under ordinary light illumination, or for the undeveloped part (to be referred to hereinafter as "background") not to turn black, the materials must be subjected to treatments such as stopping, fixation, rinsing or stabilization. Accordingly, the processing of the photographic material is time-consuming and laborious. Moreover, the handling of various chemical involves risks to the human body, and also the contamination of the processing rooms or the hands or garments of the working personnel. It is therefore very desirable to improve photographic processes which use silver halides so that the processing of the photographic material can be performed in the dry state without using a wet treatment, and the processed image is maintained stable.

Various efforts have been made to achieve this improvement. One of these efforts has resulted in a photographic process using a thermodevelopable photographic material comprising as a photographic element a major amount of a silver salt of a long-chain aliphatic carboxylic acid, such as silver behenate, saccharin.silver, or benzothiazo.silver, and a catalytic amount of a silver halide, as disclosed in U.S. Pat. Nos. 3,152,904; 3,457,075; 3,635,719; 3,645,739 and 3,756,829 and Japanese Patent Publication No. 22,185/70.

When, for example, a photographic material comprising a composition consisting of a fatty acid-silver salt, a reducing agent and a catalytic amount of a silver halide, as one of the thermodevelopable photographic materials heretofore proposed, is heated, an oxidation-reduction reaction between the fatty acid-silver salt and the reducing agent occurs due to the catalytic action of the silver halide at the exposed portion to form a silver image. However, at the same time, an oxidation-reduction reaction proceeds also at the non-exposed portion to cause undesirable fog.

In an attempt to prevent fog formation, a method has already been proposed in which a compound capable of donating a mercury ion is used. For example, U.S. Pat. No. 3,589,903 discloses that a thermodevelopable material having a reduced tendency to fog formation can be obtained by incorporating a compound capable of donating a mercury ion into a composition consisting of an organic silver salt, a reducing agent and a catalytic amount of a photographic silver halide.

As is well known, however, mercury compounds are toxic, and the photographic processing operation could be very risky. Furthermore, if unwanted coating solution containing mercury ions are discharged into rivers or the like, the mercury builds up in the fish and shellfish, and will cause serious problems upon human consumption. Also when photographic materials containing mercury compounds are re-used, for example, as regenerated paper, the mercury compounds leach out to cause similar problems.

Accordingly, an object of this invention is to provide a thermodevelopable photographic material containing a compound which is not toxic, in contrast to mercury compounds, but which possesses a fog inhibiting effect as is obtained with mercury compounds.

Another object of this invention is to provide a thermodevelopable photographic material whereby the image obtained after development has reduced discoloration by light.

Still another object of this invention is to provide a thermodevelopable photographic material which can give good quality images free from fog and having high image density and good contrast.

SUMMARY OF THE INVENTION

Accordingly this invention provides a thermodevelopable photographic material comprising a support and at least one layer containing (a) an organic silver salt, (b) a catalytic amount of a photosensitive silver halide or a compound capable of forming a photosensitive silver halide by reaction with the organic silver salt (a), (c) a reducing agent, (d) a binder and (e) a compound having the following general formula

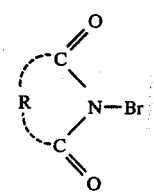

wherein R is a non-metallic atomic grouping necessary to form a heterocycle containing at least 2 nitrogen atoms in the ring together with the

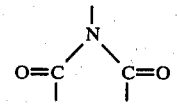

moiety in the above formula.

DETAILED DESCRIPTION OF THE INVENTION

The organic silver salt used in this invention can be a silver salt of an organic compound containing an imino or mercapto group, or a silver salt of an organic carboxylic acid. As the organic carboxylic acid, those having at least 10 carbon atoms and up to about 24 carbon atoms are preferred. Specific examples of such silver salts are the silver salt of benzotriazole, the silver salt of saccharin, the silver salt of phthalazinone, the silver salt of 3-mercapto-4-phenyl-1,2,4-triazole-silver, the silver salt of 4-hydroxy-6-methyl-1,3,3a,7-tetrazaindene, the silver salt of 2-(s-ethylthioglycolamide)-benzothiazole, silver caprate, silver laurate, silver myristate, silver palmitate, silver stearate, and silver behenate.

The component (b) is either (1) a compound capable of forming a silver halide by reaction with the silver salt (a), or (2) a silver halide. Specific examples of the compounds (1) are inorganic compounds expressed by the general formula $MX_n$ wherein M is a hydrogen atom, an ammonium group or a metal atom (for example, strontium, cadmium, zinc, tin, chromium, sodium, barium, iron, cesium, lanthanum, copper, calcium, nickel, magnesium, potassium, aluminum, antimony, gold, cobalt, mercury, lead, beryllium, lithium, manganese, gallium, indium, rhodium, ruthenium, palladium, iridium, platinum, thallium, or bismuth), X is a halogen atom (chlorine, bromine, or iodine), and $n$ is 1 when M is a hydrogen atom or an ammonium group, but represents the valency of the metal when M is a metal atom; and organic halogen compounds such as triphenylmethyl chloride, triphenylmethyl bromide, 2-bromo-2-methylpropane, 2-bromobutyric acid, 2-bromoethanol, dichlorobenzophenone, iodoform, bromoform, and carbon tetrabromide. Examples of compounds (2) include silver chloride, silver bromide, silver bromoiodide, silver chlorobromoiodide, silver chlorobromide, and silver iodide.

These silver halides can be in the form of either coarse particles or fine particles, but silver halide emulsions in the form of very fine grains are especially useful, for example, particles ranging in size from about 10 A to 10,000 A, 100A to 1,000 A. The above described silver salts generally have a particle size of about 0.05$\mu$ to 10$\mu$, preferably 0.1$\mu$ to 5$\mu$.

Emulsions containing photographic silver halides can be prepared by any desired method known in the photographic art. The emulsions can, for example, be those prepared by a single jet method, those prepared by a double jet method, Lippmann emulsions, ammonia-process emulsions, or thiocyanate or thioether ripened emulsions, or those disclosed in U.S. Pat. Nos. 2,222,264; 3,320,069 and 3,271,157.

The silver halides used in this invention can be sensitized by, for example, a reducing agent, a sulfur or selenium compound, or a gold, platinum or palladium compound, which are generally used as chemical sensitizers for silver halides. Suitable sensitizing methods are disclosed, for example, in U.S. Pat. Nos. 2,623,499; 2,399,083; 3,297,447 and 3,297,446.

The compounds as component (b) can be used either alone or in combination of two or more. A suitable amount of the compound (b) is 0.001 to 0.5 mol per mol of the organic silver salt (a). If the amount of the component (b) is smaller than the 0.001 mol per mol of the organic silver salt (a), the sensitivity of the photographic material is reduced. If it is larger than 0.5 mol per mol of the silver salt (a), the non-image portion of the thermodeveloped photographic material may turn black upon standing under indoor light, which in turn results in an impairment of the contrast between the image portion and the non-image portion.

The reducing agent as component (c) used in this invention must be one suitable for reducing the organic silver salt to a silver image when heated in the presence of a catalytic amount of the exposed silver halide. Suitable reducing agents are determined in relation to the organic silver salt employed, but specific examples include substituted phenols, substituted or unsubstituted bisphenols, substituted or unsubstituted naphthols di- or poly-hydroxybenzenes, di- or poly-hydroxynaphthalenes, hydroquinone monoethers, ascorbic acid or its derivatives such as iso ascorbic acid, ascorbic acid mono myristate, ascorbic acid mono stearate, ascorbic acid mono palmitate, ascorbic acid mono behenate, ascorbic acid mono laurate, ascorbic acid di-stearate, ascorbic acid di-palmitate, ascorbic acid di-laurate, ascorbic acid di-myristate, 3-pyrazolidones, pyrazoline-5-ones, reducing saccharides, kojic acid, and hinokitiol.

More specific examples of such reducing agents are hydroquinone, methylhydroquinone, chlorohydroquinone, bromohydroquinone, phenylhydroquinone, hydroquinone monosulfonic acid salt, t-octylhydroquinone, t-butylhydroquinone, 2,5-dimethylhydroquinone, 2,6-dimethylhydroquinone, methoxyhydroquinone, ethoxyhydroquinone, p-methoxyphenol, p-ethoxyphenol, hydroquinone monobenzyl ether, catechol, pyrogallol, resorcinol, p-aminophenol, o-aminophenol, N-methyl-p-aminophenol, 2-methoxy-4-aminophenol, 2,4-diaminophenol, 2-$\beta$-hydroxyethyl-4-aminophenol, p-t-butylphenol, p-t-amylphenol, p-cresol, 2,6-di-t-butyl-p-cresol, p-acetophenol, p-phenylphenol, o-phenylphenol, 1,4-dimethoxyphenol, 3,4-xylenol, 2,4-xylenol, 2,6-dimethoxyphenol, sodium 1-amino-2-naphthol-6-sulfonate, 1-naphthylamine-7-sulfonic acid, 1-hydroxy-4-methoxynaphthalene, 1-hydroxy-4-ethoxynaphthalene, 1,4-dihydroxynaphthalene, 1,3-dihydroxynaphthalene, 1-hydroxy-4-aminonaphthalene, 1,5-dihydroxynaphthalene, 1-hydroxy-2-phenyl-4-methoxynaphthalene, 1-hydroxy-2-methyl-4-methoxy-naphthalene, $\alpha$-naphthol, $\beta$-naphthol, 1,1'-dihydroxy-2,2'-binaphthyl, 4,4'-dimethoxy-1,1'-dihydroxy-2,2'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl) methane, bisphenol A, 1,1-bis-(2-hydroxy-3,5-dimethylphenyl)-3,5,5-trimethylhexane, 2,4,4-trimethylpentyl-bis-(2-hydroxy-3,5-dimethylphenyl)methane, bis(2-hydroxy-2-t-butyl-5-methylphenyl)methane, bis(2-hydroxy-3,5-di-t-butylphenyl)methane, 4,4'-methylenebis(3-methyl-5-t-butylphenol), 4,4'-methylenebis(2,6-di-t-butylphenol), 2,2'-methylenebis(2-t-butyl-4-ethylphenol), 2,6-methylenebis(2-hydroxy-3-t-butyl-5-methylphenyl)-4-methylphenol, 3,3',5,5'-tetra-t-butyl-4,4'-dihydroxybiphenyl, l-ascorbic acid, a monoester of l-ascorbic acid, a diester of l-ascorbic acid, p-hydroxyphenyl glycine, N,N-diethyl-p-phenylene diamine, furoin, benzoin, dihydroxyacetone, glycerine aldehyde, rhodizonic acid-tetrahydroxyquinone, methyl gallate, propyl gallate, hydroxytetronic acid, N,N-di(2-ethoxyethyl)hydroxylamine, glucose, lactose, 1-phenyl-3-pyrazolidone, 4-methyl-4-hydroxy-methyl-1-phenyl-3-pyrazolidone, 4-methyl-4-hydroxy-5-t-butylphenyl)-sulfide, 3,5-di-t-butyl-4-hydroxybenzyldimethylamine, and $\alpha,\alpha'$-(3,5-dibutyl-4-hydroxyphenyl)dimethyl ether.

These reducing agents can be used alone or in admixture of two or more. Suitable reducing agents are selected according to the organic silver salt. For example, a higher fatty acid silver salt such as silver behenate is comparatively difficult to reduce, and therefore, a comparatively strong reducing agent such as a bisphenol, e.g., 4,4'-methylenebis-(3-methyl-5-t-butylphenol), is suitable. On the other hand, for a relatively easily reducible silver salt such as silver laurate, a relatively weak reducing agent such as a substituted phenol, e.g., p-phenylphenol, is suitable. For a silver salt which can be reduced only with difficulty, such as benzotriazole-silver, the use of a strong reducing agent such as an ascorbic acid is suitable.

The amount of the reducing agent cannot be unequivocally set forth because it varies depending on the organic silver salt and reducing agent to be used. Usually, a suitable amount is 0.1 to 5 mols per mol of the organic silver salt.

A very important component (e) used in this invention is a compound having the following general formula

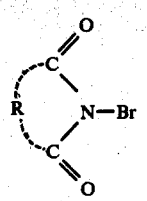

wherein R is a non-metallic atomic grouping necessary to form a heterocyclic ring (preferably a 5- or 6-membered) containing at least 2 nitrogen atoms in the ring together with the

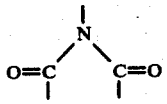

moiety of the above formula, which acts as a fog inhibitor. For example, R may be an imidazolidinedione ring, a 1,2,4-triazolidine-3,5-dione ring, a piperazinedione ring, a pyrimidine-2,4,6-trione ring and a s-triazine-2,4,6-trione ring, these rings can be substituted with one or more alkyl groups having 1–5 carbon atoms, phenyl or naphthyl groups and/or alkaline metals (e.g., K, Na, Li).

Specific examples of compounds expressed by the above formula are shown below:

Compound No. 1

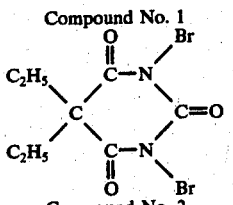

Compound No. 2

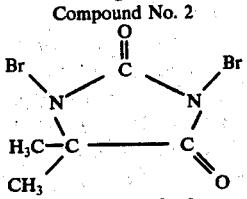

Compound No. 3

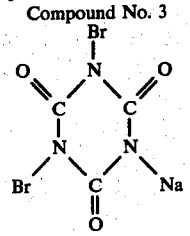

-continued

Compound No. 4

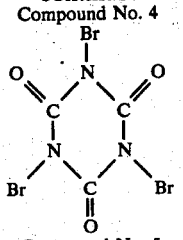

Compound No. 5

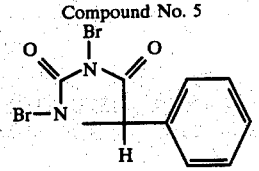

Most of these compounds are commercially available, and the others can be synthesized using methods described in the literature or similar methods.

A suitable amount of the component (e) is about $10^{-4}$ mol to 1 mol, preferably about $10^{-3}$ to 0.1 mol, per mol of the organic silver salt. If the amount is less than about $10^{-4}$ mol per mol of the organic silver salt, the heat fog inhibiting effect is poor, and if it exceeds about 1 mol per mol of the organic silver salt the photographic properties of the photographic material are impaired, for example, the image density is reduced.

Component (e) of the present invention prevents a thermodevelopable photographic material from fogging and increases image density. In addition, component (e) prevents light-discoloration of the thermodevelopable photographic material.

Non-halogen containing cyclic imide compounds which have chemical structures similar to components (e) of the present invention are disclosed in U.S. Pat. No. 3,846,136, but have no effects for preventing fog.

Preferably, the component (e) is incorporated in the photographic material in the form of a solution in a solvent. Preferably, it is added to the silver salt (a) before or after its preparation, or to the silver halide (b) before or after its preparation. It is also possible to first form a layer of components (a), (b), (c) and (d) on the support and then to immerse the layer in a solution containing the component (e). Alternatively, a layer containing the component (e) can be formed adjacent a layer containing the component (a) and/or the component (b).

Preferably, the components (a), (b), (c) and (e) are dispersed in a binder (d), and coated on a support. At this time, all of the components (a), (b), (c) and (e) can be dispersed in a binder and coated on a support as one layer. Alternatively, the components (a), (b), (c) and (e) can be divided into groups and dispersed in binders separately, and coated on a support as separate layers. A suitable coating amount can range from about 0.3g(as silver)/m² to 3g/m², preferably 0.4g/m² to 1.5g/m².

The binder can be those conventionally used in the art. Usually, hydrophobic binders are suitable, but hydrophilic binders can also be used. Preferably, these binders are transparent or semi-transparent, and may, for example, be natural substances such as gelatin, gelatin derivatives, or mixtures of these with latex-form vinyl polymers, or cellulose derivatives, and synthetic polymers. Specific examples include gelatin, phthalic-modified gelatin, polyvinyl butyral, polyacrylamide, cellulose acetate propionate, poly(methyl methacrylate), polyvinyl pyrrolidone, polystyrene, ethyl cellulose, polyvinyl chloride, chlorinated rubbers, polyisobutylene, a butadiene/styrene copolymer, a vinyl chloride/vinyl acetate copolymer, a vinyl acetate/vinyl chloride/maleic acid copolymer, polyvinyl alcohol, polyvinyl acetate, benzyl cellulose, cellulose acetate, cellulose propionate, and cellulose acetate phthalate. These compounds can be used as a mixture of two or more as required.

A suitable amount of the binder is a weight ratio of about 4:1 to 1:4 based on the organic silver salt.

If the compound (a) or (c) is a high molecular weight substance which can concurrently act as a binder, the use of the binder component (d) can be omitted.

A wide variety of materials can be used in this invention as a support for the photographic material. Typical examples are a cellulose nitrate film, a cellulose ester film, a poly (vinyl acetal) film, a polystyrene film, a poly (ethylene terephthalate) film, a polycarbonate film, a glass sheet, a paper, or a metal sheet.

An antistatic layer or electrically conducting layer can be provided in the thermodevelopable photographic material of this invention. It is also possible to incorporate an antihalation substance or an antihalation dye. Suitable antihalation layers are disclosed in U.S. Pat. Nos. 3,769,019; 3,745,009 and 3,615,432.

If desired, the thermodevelopable photographic material of this invention can further contain a matting agent such as starch, titanium dioxide, zinc oxide or silica, or a fluorescent brightening agent such as a stilbene, triazine, oxazole or coumarin.

The thermodevelopable photographic layer used in the performance of the present invention can be coated by various methods, for example, the immersion method, the air knife method, the curtain coating method, or the extrusion coating method using a hopper as is disclosed in the U.S. Pat. No. 2,681,294. If desired, two or more layers can be coated at a time.

Some of the optical sensitizing dyes which have previously proved effective for silver halide photographic emulsions can be advantageously used to provide additional photosensitivity to the thermodevelopable photographic material of this invention. For example, the thermodevelopable photographic material of this invention can be optically sensitized by adding a sensitizing dye as a solution or dispersion in an organic solvent. Examples of useful optical sensitizing agents are the cyanines and merocyanines. The amount of the sensitizing dye is about $10^{-6}$ to about $10^{-2}$ mol per mol of the organic silver salt.

In order to increase the transparency of the thermodevelopable photographic layer and the density of the image, and also improve the fresh storability of the photographic material (the ability of the photographic material to maintain its photographic characteristics which exist immediately after its preparation even at the end of storage), a top coat of a polymer layer can be formed on the photosensitive layer. A suitable thickness of the top-coat polymer layer is 1 to 20 microns. Examples of suitable polymers which can be used for this purpose are polyvinyl chloride, polyvinyl acetate, a copolymer of vinyl chloride and vinyl acetate, polyvinyl butyral, polystyrene, poly (methyl methacrylate), a polyurethane rubber, a xylene resin, benzyl cellulose, ethyl cellulose, cellulose acetate butyrate, cellulose acetate, polyvinylidene chloride, chlorinated polypropylene, polyvinyl pyrrolidone, cellulose propionate, polyvinyl formal, cellulose acetate phthalate, polycarbonate, and cellulose acetate propionate.

The thermodevelopable photographic material described above is developed merely by exposing it to a light source such as a xenon lamp, tungsten lamp or mercury lamp, and then heating it. A suitable heating temperature is 100° to 160° C, preferably 110° to 140° C. Higher or lower temperatures within this range can be employed by prolonging or shortening the heating time. The developing time is usually about 1 to 60 seconds.

Suitable dyes including trinuclear merocyanine dyes and merocyanine dyes are disclosed in U.S. Pat. Nos. 3,719,495; 3,761,279 and 3,457,075.

Various means are available to develop the photographic material of this invention by heating. For example, the photographic material can be brought into contact with a simple heating plate or with a heated drum, or may be passed through a heated area. Alternatively, the heating can be effected by high frequency induction heating, or by using laser beams.

The thermodevelopable photographic material of this invention has a reduced tendency to fog formation and gives a high image density. Furthermore, there is a reduced discoloration of the developed photographic material by light. Accordingly, the use of the thermodevelopable photographic material of this invention makes it possible to form clear images of sharp contrast for prolonged periods of time.

The following Examples illustrate the present invention in greater detail. Unless otherwise indicated, all parts, percents ratios and the like are by weight.

EXAMPLE 1

Behenic acid (3.4g) was dissolved at 60° C in 100 ml of toluene, and the solution was maintained at 60° C. While stirring the solution with a stirrer, 100ml of a dilute aqueous solution of nitric acid whose pH was adjusted to 2.0 at 25° C with nitric acid was mixed with the solution. The mixed solution was maintained at 60° C, and with stirring with a stirrer, an aqueous solution obtained by adding aqueous ammonia to about 80ml of an aqueous solution containing 1.7g of silver nitrate to form a silver.ammonium complex salt and further adding water to make the total amount 100ml was added thereby to form a dispersion containing microcrystals of silver behenate. When the dispersion was allowed to stand for 20 minutes, it separated into an aqueous phase and a toluene phase.

The aqueous phase was first removed, and the toluene phase was washed with 400ml of water by the decantation method. This operation was repeated three times, and then after adding 400ml of toluene, it was subjected to centrifugal separation to collect the silver behenate. 4g of silver behenate was obtained in the form of spindles each of which measured about 1 micron along its long side and about 0.05 micron along its short side.

The silver behenate (2.5g) was added to 20ml of an isopropyl alcohol solution containing 2g of polyvinyl butyral, and the mixture was processed on a ball mill for 1 hour to form a polymer dispersion of the silver salt. The following ingredients were added to 20ml of this polymer dispersion of the silver salt to form a thermodevelopable photographic composition.

| Formulation of the Composition | |
|---|---|
| Ammonium Bromide (a 2.5% by weight methanol solution) | 1 ml |

-continued

| Formulation of the Composition | |
|---|---|
| Benzoxazolylidene Rhodanine (a 0.025% by weight chloroform solution) | 1 ml |
| 2,2'-Methylenebis (6-t-butyl-4-methyl-phenol) (a 2.5% by weight methyl cellosolve solution) | 3 ml |
| Phthalazinone (a 2.5% by weight methyl cellosolve solution) | 1 ml |
| Compound No. 1 (a 5% by weight methyl cellosolve solution) | 1 ml |
| Tetrachlorophthalic Anhydride (a 0.6% by weight methanol solution) | 1 ml |

The resulting composition was coated on a polyethylene terephthalate film in an amount of 1.5g (as silver) per square meter of the support film, thereby to form a thermodevelopable photographic material (A). For comparison, a thermodevelopable photographic material (B) was prepared in the same manner as described above except that Compound No. 1 as a heat fog inhibitor was not added. Furthermore, a thermodevelopable photographic material (C) was prepared in the same manner as described above except that 1ml of a 5% by weight methanol solution of mercuric bromide was used instead of the ammonium bromide, and Compound No. 1 as a heat fog inhibitor was not added.

Each of these photographic materials was given an exposure of 240,000 luxes.second using a tungsten light source, and then developed by heating for 10 seconds at 120° C. Then, the blackening transmission density of the developed photographic materials was measured. Furthermore, other pieces of the photographic materials (A) to (C) were each heated at 120° C for 10 seconds without exposure. The transmission density was measured, and the presence of fog was examined.

The standard point of the measurement of the transmission density was set at the base film of the photographic material (in all of the following Examples, this standard was applied).

The degree of light discoloration, as shown in the following tables, is expressed by $\Delta D = D_A - D_B$ wherein $D_A$ is the transmission density of the sample after exposure to an indoor fluorescent light, and $D_B$ is the transmission density of the sample immediately after processing and in the unexposed state. This also applies to all of the following Examples.

| | Photographic Material (A) | Photographic Material (B) | Photographic Material (C) |
|---|---|---|---|
| Blackening Transmission Density | 2.0 | 2.2 | 1.0 |
| Heat Fog | 0.14 | 0.4 | 0.13 |
| Degree of Light Discoloration (ΔD) | +0.10 | +0.34 | +0.35 |

The results obtained demonstrate that Compound No. 1 [component (e)] has a remarkable heat fog inhibiting effect [compare photographic material (A) with photographic material (B)].

A comparison of the photographic material (A) containing Compound No. 1 as a heat fog inhibitor with the photographic material (C) containing the mercury compound which is a known heat fog inhibitor shows that the degree of heat fog formation is slightly larger in the photographic material (A), but the transmission density of the image increases greatly in the photographic material (A) to give an image of good contrast. The light discoloration of the background after 24 hour exposure of the processed photographic material to an indoor fluorescent lamp (about 300 luxes) was less in the photographic material (A).

Accordingly, since the compound as component (e) used in this invention is less toxic than the mercury compound, it is a very effective and desirable heat fog inhibitor.

EXAMPLE 2

A solution of 11g of lauric acid in 100ml of butyl acetate was maintained at 10° C, and with stirring with a stirrer 100ml of a dilute aqueous solution of nitric acid (having a pH of 2.0 at 25° C) was mixed with the above solution. With continued stirring, 50ml of an aqueous solution (cooled to 0° C) of a silver nitrate.ammonium complex salt containing 8.5g of silver nitrate was added over the course of 1 minute to allow the lauric acid to react with the silver ion. Silver laurate crystals were obtained in the form of spindles each of which measured about 1 micron along its long side and about 0.05 micron along its short side. The silver salt obtained was washed with water, and then with methanol, and 3.0g of polyvinyl butyral and 20ml of isopropyl alcohol, both based on 2.7g of the silver laurate, were added. The mixture was processed in a ball mill to form a polymer dispersion of the silver salt.

The following ingredients were added to 20ml of the polymer dispersion to form a thermodevelopable photographic composition

| Formulation of the Composition | |
|---|---|
| Ammonium Bromide (a 2.5% by weight methanol solution) | 1 ml |
| Benzoxazolylidene Rhodanine (a 0.025% by weight chloroform solution) | 1 ml |
| p-Phenylphenol (a 70% by weight methyl cellosolve solution) | 3 ml |
| Phthalazinone (a 2.5% by weight methyl cellosolve solution) | 1 ml |
| Tetrachlorophthalic Anhydride (a 0.6% by weight methanol solution) | 1 ml |
| Compound No. 2 (a 5% by weight methyl cellosolve solution) | 1 ml |

The composition was coated on a polyethylene terephthalate film in an amount of 1.7g as silver per square meter of the support film to form a thermodevelopable photographic material (A). For comparison, a thermodevelopable photographic material (B) was prepared in the same way as described above except that the Compound No. 2 as a heat fog inhibitor was not added. Furthermore, a thermodevelopable photographic material (C) was also prepared in the same way as described above except that 1ml of a 5% by weight methanol solution of mercuric bromide was used instead of the ammonium bromide and Compound No. 2 was not added.

A 15% by weight tetrahydrofuran solution of a copolymer of 95% by weight vinyl chloride and 5% by weight vinyl acetate was further coated on the photosensitive layer of each of the photographic materials (A) to (C) in a dry thickness of 10 microns.

Each of these photographic materials (A) to (C) was given an exposure of 240,000 luxes.second using a tungsten light source, and then heated at 120° C for 10 seconds. Then, the blackening transmission density of the developed photographic materials was measured. Other pieces of the photographic materials (A) to (C) were each heated at 120° C for 10 seconds without exposure.

The presence of heat fog was examined by measuring the transmission density of the developed photographic materials.

The results obtained are shown below.

| | Photographic Material (A) | Photographic Material (B) | Photographic Material (C) |
|---|---|---|---|
| Blackening Transmission Density | 1.7 | 1.8 | 0.8 |
| Heat Fog | 0.17 | 0.45 | 0.15 |
| Degree of Light Discoloration (ΔD) | +0.15 | +0.42 | +0.45 |

The results obtained demonstrate that the fog of the photographic material (A) containing Compound No. 2 is slightly greater than that of the photographic material (C) containing the mercury compound which is a conventional heat fog inhibitor. However, the photographic material (A) has a higher blackening transmission density to provide an image of good contrast. When the processed photographic material was exposed to the indoor illumination of a fluorescent lamp, the light discoloration of the background portion of the photographic material of this invention is extremely reduced as compared with the photographic material containing the mercury compound.

EXAMPLE 3

The procedure of Example 4 was repeated except that the same amount of Compound No. 1 was used instead of Compound No. 5. The results obtained are shown in the following table. It can be seen that the same effect as obtained in Example 4 was obtained.

| | Photographic Material (A) | Photographic Material (B) | Photographic Material (C) |
|---|---|---|---|
| Blackening Transmission Density | 1.7 | 1.8 | 0.8 |
| Heat Fog | 0.16 | 0.45 | 0.15 |
| Degree of Light Discoloration (ΔD) | +0.15 | +0.42 | +0.45 |

EXAMPLE 4

Benzotriazole (6g) was dissolved at 50° C in 100ml of isoamyl acetate, and the solution was cooled to −15° C and maintained at this temperature. With stirring with a stirrer, a solution of 8.5g of silver nitrate in 100ml of a dilute aqueous solution of nitric acid whose pH had been adjusted to 2.0 at 25° C with nitric acid and which was maintained at 3° C was added to the cooled solution, thereby to form a dispersion containing fine crystals of silver salt of benzotriazole.

When the dispersion was allowed to stand at room temperature (about 20° - 30° C) for 20 minutes, it separated into an aqueous phase and an isoamyl acetate phase. The aqueous phase was first removed, and the isoamyl acetate phase was washed with 400ml of water by the decantation method. This operation was repeated three times, and then 400ml of methanol was added. The mixture was subjected to centrifugal separation to collect silver salt of benzotriazole in an amount of 8g. The silver salt of benzotriazole particles obtained were nearly spherical with a particle diameter of about 1 micron. The silver salt of benzotriazole (2.5g) was added to 40ml of an isopropyl alcohol solution containing 4g of polyvinyl butyral. The mixture was processed in a ball mill to form a polymer dispersion of the silver salt. The following ingredients were added to 40ml of the polymer dispersion of the silver salt to form a thermodevelopable photographic composition.

| Formulation of the Composition | |
|---|---|
| Ammonium Iodide (a 8.5% by weight methanol solution) | 1 ml |
| Solution of 2g of Ascorbic Acid Monopalmitate and 2g of Ascorbic Acid Dipalmitate in 10ml of Methyl Cellosolve | 10 ml |
| Benzoxazolylidene Rhodanine (as a Sensitizing Dye, a 0.2% by weight chloroform solution) | 1 ml |
| N-Ethyl-N'-dodecylurea (a 2.5% by weight methyl cellosolve solution) | 2 ml |
| Compound No. 2 (a 5% by weight methyl cellosolve solution) | 2 ml |

The resulting thermodevelopable photographic composition was coated on a polyethylene terephthalate film in an amount of 1.2g as silver per square meter of the support film to form a thermodevelopable photographic material (A).

For comparison, a thermodevelopable photographic material (B) was prepared in the same manner as described above except that Compound No. 2 as a heat fog inhibitor was not added. Furthermore, a thermodevelopable photographic material (C) was prepared in the same way as described above except that 2ml of a 5% by weight methanol solution of mercuric bromide was used instead of the ammonium iodide, and Compound No. 2 as a heat fog inhibitor was not added.

A 15% by weight tetrahydrofuran solution of a copolymer of 95% by weight vinyl chloride and 5% by weight vinyl acetate was coated further on the photosensitive layer of each of the photographic materials (A) to (C) in a dry thickness of 8 microns.

Pieces of these photographic materials (A) to (C) were each given an exposure of 1,200,000 luxes.second using a tungsten light source, and heated at 130° C for 30 seconds for development. Then, the blackening transmission density of the photographic materials was examined. Furthermore, other pieces of the photographic materials (A) to (C) were each heated at 130° C for 30 seconds without exposure, and the presence of fog was examined by measuring the blackening transmission density. The results obtained are shown in the following table.

| | Photographic Material (A) | Photographic Material (B) | Photographic Material (C) |
|---|---|---|---|
| Blackening Transmission Density | 0.93 | 0.92 | 0.60 |
| Heat Fog | 0.13 | 0.38 | 0.12 |
| Degree of Light Discoloration (ΔD) | +0.08 | +0.21 | +0.23 |

The results obtained demonstrate that the heat fog on the photographic material (A) containing the heat fog inhibitor in accordance with the present invention is slightly greater than that on the photographic material (C) containing the known mercury compound as a heat fog inhibitor, but the blackening transmission density is high and an image of good contrast is obtained. When the processed photographic material was exposed to the indoor illumination of a fluorescent lamp, the light discoloration of the background was remarkably reduced as compared with the photographic material containing the mercury compound.

EXAMPLE 5

Preparation of Silver Behenate 340 g of behenic acid was added, while agitating, to 5.1 of water which was warmed to 85° C, to form solution A. Thereafter, an aqueous solution of 20 g of sodium hydroxide in 500 ml of water was added to solution A over 5 minutes. The solution was agitated for 15 minutes at 85° C and then cooled to 30° C over 30 minutes. An aqueous solution of 85 g of silver nitrate in 500 ml of water was then added to the system over 5 minutes. The solution was further agitated for 90 minutes at 30° C. Thereafter, a solution of 40 g of polyvinyl butyral in 1 l of isoamyl acetate was added to the system. The mixture was agitated for 10 minutes and centrifuged at 300 rpm for 30 minutes. The supernatant was then removed by decantation, 400 ml of isopropanol was added to the system. After agitating for 10 minutes at 30° C, a solution of 270 g of polyvinyl butyral in 1800 ml of isopropanol was added to redisperse a silver behenate-behenic acid mixture. To this polymer dispersion containing the silver behenate-behenic acid mixture was added 0.5 mol of N-bromosuccinic imide. The mixture was heated at 50° C for 60 minutes to prepare silver bromide having contacted catalytically with a part of silver behenate.

Preparation of Thermodevelopable Materials

The thus obtained silver behenate-behenic acid-silver bromide-polyvinyl butyral emulsion was divided into 100 parts (each contained 1/200 mol of silver behenate). Each component shown below was added at 5 minute intervals at 30° C in the order indicated below to make a coating liquid.

(a) Sensitizing Dye having the formula below (0.01 wt% methyl cellosolve solution) 2 ml -continued

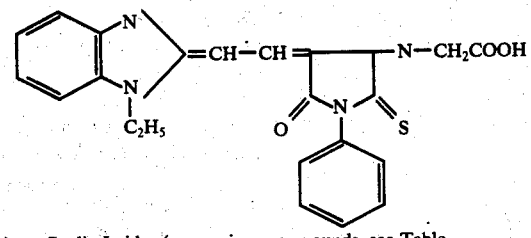

(b) Cyclic Imides (comparison compounds, see Table below)

(c) Phthalazinone (color toning agent) 5 ml (4.5 wt% solution in methyl cellosolve:methanol = 50:50 volume ratio)

(d) Reducing Agent [1,1-bis(2-hydroxy-3,5-dimethylphenyl)-3,5,5-trimethylhexane] (10 wt% acetone solution) 8 ml The thus obtained coating liquids were coated on a paper support which was size-pressed on both faces by polyvinyl alcohol, in an amount of 0.4 g (silver) per square meter of the paper support to form photographic materials (the amount of polyvinyl alcohol was about 1 g per square meter of the paper support). After these photographic materials were dried at 70° C for 10 minutes, they were cut into pieces.

Each piece of these photographic materials was exposed to a 3,000 luxes second tungsten light source through a step-wedge. The materials were then attached to a heated board at 130° C for 6 seconds and thermally developed.

As in Example 1 of the present invention, the degree of light discoloration $\Delta D$ was measured (however, these materials were irradiated at a distance of 10 cm for 3 minutes using a 500 W mercury arc.) The results are shown in the Table below. Samples 2–5 are not within the present invention. In these samples, the inside is not substituted with a bromine. Samples 6–9 are prepared in accordance with the invention and correspond to Samples 2–5 with the exception of the bromine atom. Samples 10–13 are in accordance with the invention.

TABLE

| Sample No. | Cyclic Imide 3/ | Amount | D max | D min | ΔD |
|---|---|---|---|---|---|
| 1 (control) | None | — | 1.48 | 0.62 | 0.30 |
| 2 | 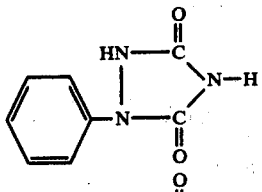 | 0.0022 wt % 1/ solution 4ml | 1.52 | 0.62 | 0.30 |
| 3 | | 0.022 wt % 1/ solution 4ml | 1.48 | 0.48 | 0.30 |
| 4 | | 0.22 wt % 1/ solution 4ml | 1.40 | 0.30 | 0.35 |
| 5 | | 2.2 wt % 1/ solution 4ml | 1.35 | 0.30 | 0.45 |
| 6 | 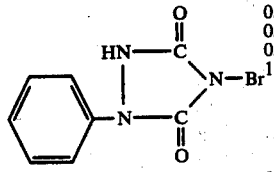 | 0.0016 wt % 2/ solution 8ml | 1.44 | 0.21 | 0.30 |
| 7 | | 0.016 wt % 2/ solution 8ml | 1.50 | 0.16 | 0.25 |
| 8 | | 0.16 wt % 2/ solution 8ml | 1.60 | 0.13 | 0.30 |
| 9 | | 1.6 wt % 2/ solution 8ml | 1.36 | 0.08 | 0.35 |
| 10 | 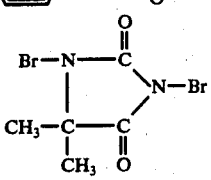 | 0.0036 wt % 3/ solution 4ml | 1.58 | 0.13 | 0.25 |
| 11 | | 0.036 wt % 3/ solution 4ml | 1.57 | 0.21 | 0.25 |
| 12 | | 0.36 wt % 3/ solution 4ml | 1.61 | 0.20 | 0.25 |
| 13 | | 3.6 wt % 3/ solution 4ml | 1.40 | 0.20 | 0.30 |

1/mixed solvent of ethanol; dimethyl formamide = 80:20 (volume ratio)

2/ mixed solvent of ethanol; acetone; dimethyl formamide = 40:50:10 (volume ratio)

3/ Samples 2 - 5 correspond to prior art and Samples 6 to 13 correspond to the present invention.

While the invention has been described in detail and with reference to specific embodiments thereof, it will be apparent to one skilled in the art that various changes and modifications can be made therein without departing from the spirit and scope thereof.

What is claimed is:

1. A thermodevelopable photographic material comprising a support having thereon at least one layer containing (a) an organic silver salt, (b) a catalytic amount of a photosensitive silver halide or a compound capable of forming a photosensitive silver halide by reaction with the organic silver salt (a), (c) a reducing agent, (d) a binder, and (e) a compound having the following general formula

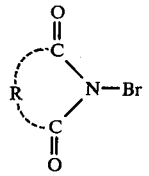

wherein R is a non-metallic atomic grouping necessary to form a heterocyclic ring containing at least 2 nitrogen atoms in the ring inclusive of the nitrogen in the

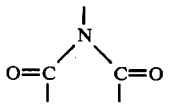

moiety in the above formula.

2. The photographic material of claim 1, wherein the amount of said component (b) is 0.001 to 0.5 mol per mol of said organic silver salt (a).

3. The photographic material of claim 1, wherein the amount of said component (c) is 0.1 to 5 mols per mol of said organic silver salt (a).

4. The photographic material of claim 1, wherein the weight ratio of said binder (d) to said organic silver salt (a) ranges from 4:1 to 1:4.

5. The photographic material of claim 1, wherein the amount of said component (e) is $10^{-4}$ mol to 1 mol per mol of said organic silver salt (a).

6. The photographic material of claim 5, wherein the amount of the component (e) is $10^{-3}$ mol to 0.1 mol per mol of said organic silver salt (a).

7. The photographic material of claim 1, wherein said organic silver salt (a) is a silver salt of an organic compound containing an imino or mercapto group, or a silver salt of an organic carboxylic acid having at least 10 carbon atoms.

8. The photographic material of claim 1, wherein said component (b) which is capable of forming a photosensitive silver halide by reaction with said organic silver salt (a) is selected from the group consisting of (i) an inorganic halogen compound of the general formula $MX_n$, wherein M is a hydrogen atom, an ammonium group or a metal atom, X is a halogen atom, and $n$ is 1 when M is a hydrogen atom or an ammonium group, or represents the valency of the metal when M is a metal atom, and (ii) an organic halogen compound.

9. The photographic material of claim 1, wherein said reducing agent (c) is selected from the group consisting of substituted phenols, substituted or unsubstituted bisphenols, substituted or unsubstituted naphthols, di- or poly-hydroxybenzenes, di- or poly-hydroxynaphthalenes, hydroquinone monoethers, ascorbic acid, ascorbic acid esters, 3-pyrazolidones, pyrazoline-5-ones, reducing saccharides, kojic acid, and hinokitiol.

10. The photographic material of claim 1, including a topcoating layer of a polymer on said photographic layer.

11. The photographic material of claim 10, wherein said topcoating layer has a thickness of 1 to 20 microns.

12. The photographic material of claim 1, wherein said compound having the general formula is Compound No. 1

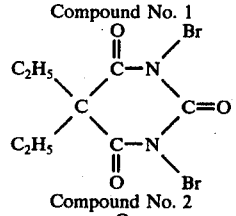

Compound No. 2

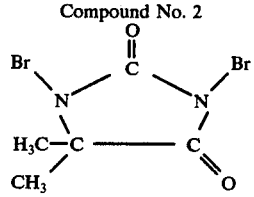

Compound No. 3

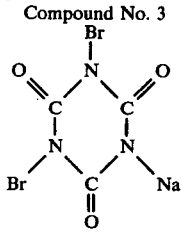

Compound No. 4

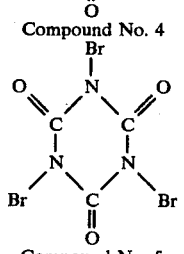

Compound No. 5

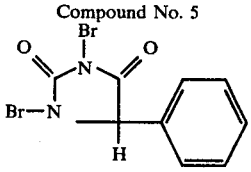

* * * * *